US008573322B2

(12) United States Patent
Nagasaka et al.

(10) Patent No.: US 8,573,322 B2
(45) Date of Patent: Nov. 5, 2013

(54) HOOK FOR ELECTRIC POWER TOOLS AND ELECTRIC POWER TOOL EQUIPPED WITH THE HOOK

(75) Inventors: Hidenori Nagasaka, Anjo (JP); Ryunosuke Kumagai, Anjo (JP)

(73) Assignee: Makita Corporation, Anjo-shi (JP)

( * ) Notice: Subject to any disclaimer, the term of this patent is extended or adjusted under 35 U.S.C. 154(b) by 386 days.

(21) Appl. No.: 12/950,288

(22) Filed: Nov. 19, 2010

(65) Prior Publication Data

US 2011/0139479 A1 Jun. 16, 2011

(30) Foreign Application Priority Data

Dec. 10, 2009 (JP) ..... 2009-280836
Oct. 29, 2010 (JP) ..... 2010-244326

(51) Int. Cl.
*A45F 5/00* (2006.01)
*E21B 12/00* (2006.01)

(52) U.S. Cl.
USPC ..... 173/171; 81/180.1; 224/269; 224/271

(58) Field of Classification Search
USPC ..... 173/171; 224/268–689, 163, 904, 930, 224/690; 81/180.1; 248/690–692
See application file for complete search history.

(56) References Cited

U.S. PATENT DOCUMENTS

| | | | | |
|---|---|---|---|---|
| 4,321,755 | A * | 3/1982 | Illgen | 33/393 |
| 5,195,667 | A * | 3/1993 | Gallant | 224/197 |
| 5,944,242 | A * | 8/1999 | Musarella et al. | 224/667 |
| 6,102,264 | A * | 8/2000 | Redzisz | 224/197 |
| 6,655,560 | B2 * | 12/2003 | Kahn | 224/268 |
| 7,093,951 | B2 * | 8/2006 | Tsuruta et al. | 362/119 |
| 8,011,541 | B2 * | 9/2011 | Mikesell et al. | 224/250 |
| 8,070,027 | B2 * | 12/2011 | Piatt et al. | 224/269 |
| 2004/0050888 | A1 * | 3/2004 | Warner | 224/269 |
| 2005/0011919 | A1 * | 1/2005 | Durham | 224/248 |
| 2006/0065684 | A1 * | 3/2006 | Houcek | 224/269 |
| 2006/0237498 | A1 * | 10/2006 | Piatt et al. | 224/269 |
| 2007/0114141 | A1 * | 5/2007 | Mikesell et al. | 206/207 |
| 2007/0138227 | A1 * | 6/2007 | Rickman | 224/669 |
| 2008/0302552 | A1 * | 12/2008 | Kondo | 173/217 |

FOREIGN PATENT DOCUMENTS

| | | |
|---|---|---|
| DE | 20 2008 001 987 U1 | 7/2008 |
| EP | 1 690 649 A1 | 8/2006 |
| JP | U-6-31974 | 4/1994 |
| JP | A-9-158483 | 6/1997 |

OTHER PUBLICATIONS

European Search Report for corresponding European Patent Application No. 10192366.2, mailed on Mar. 23, 2011.

* cited by examiner

*Primary Examiner* — Alexandra Elve
*Assistant Examiner* — Andrew M Tecco
(74) *Attorney, Agent, or Firm* — Oliff and Berridge, PLC

(57) ABSTRACT

A hook for electric power tools is disclosed. The hook is used with an electric power tool comprising a handle and a battery pack detachably mounted to a lower end portion of the handle. The hook is designed to be attached to the electric power tool in the proximity of the lower end portion of the handle and includes a ring-shaped slip-off preventing portion having an opening into which, when the battery pack is not attached to the handle, the handle can be inserted into the opening of the slip-off preventing portion, and when the battery pack is attached to the handle, the slip-off preventing portion can be prevented from being pulled out from the handle by the battery pack attached to the handle.

10 Claims, 14 Drawing Sheets

HOOK FOR ELECTRIC POWER TOOLS AND ELECTRIC POWER TOOL EQUIPPED WITH THE HOOK

BACKGROUND OF THE INVENTION

This application claims the entire benefit of Japanese Patent Application Number 2009-280836 filed on Dec. 10, 2009 and 2010-244326 filed on Oct. 29, 2010, the entirety of which is incorporated by reference.

1. Field of the Invention

The present invention relates to a hook for electric power tools attached to a handle of a rechargeable electric power tool and engageable with a belt and a carabiner, etc. The present invention also relates to a rechargeable electric power tool equipped with this hook.

2. Description of Related Art

For example, Japanese Laid-open Utility Model Publication No. 6-31974 discloses a rechargeable electric power tool such as a cordless electric power tool, to which a battery pack as a power source is attached, and a hook is fixed to a lower part of a handle of the rechargeable electric power tool using a band. According to this technique, since the hook is fixed to the lower part of the handle using the band, the hook can be attached to almost all kinds of rechargeable electric power tools regardless of their shapes.

Further, Japanese Laid-open Patent Publication No. 9-158483 discloses a water proof cover configured to prevent rain water from entering a gap between a battery pack and a housing, for the purpose of eliminating adverse effects of rain water if rain water enters a rechargeable electric power tool and electrical parts stored therein get wet.

The water proof cover disclosed in this Japanese Patent publication document is rotatably supported on a handle housing through a pivoting point which is provided at a lower portion of the handle housing and outside the battery pack attached to the lower portion of the handle housing. Further, a rubber seal member is mounted on an upper edge of the water proof cover, so that the seal member enhances sealability between the water proof cover and the handle housing when the water proof cover covers the battery pack.

Such a technique disclosed in the above Japanese Utility Model publication, however, does not completely prevent the band from being loosened. For this reason, if the band is loosened while a worker wears a waist belt to which a carabiner is attached and the hook is further engaged with the carabiner, the hook becomes unfixable to the lower part of the handle. As a result, the rechargeable electric power tool disadvantageously falls from the carabiner while the hook remains engaged with the carabiner. This problem may also occur in the case where the hook is attached to the handle by a screw or the like and if the screw or the like comes off from the handle.

Further, in the case where the water proof cover is attached to the rechargeable electric power tool outside the battery pack that is attached to the lower portion of the handle housing, an attachment portion for the hook may be covered by the water proof cover. Therefore, there is concern that the hook is unable to be fixed to the handle housing.

In view of the above drawbacks of the conventional art, the present invention seeks to provide a hook for electric power tools, which can prevent the electric power tool from falling from a belt and a carabiner, etc., even if the hook incidentally becomes unfixable to the electric power tool.

SUMMARY OF THE INVENTION

In accordance with a first aspect of the present invention, as embodied and described herein, there is provided a hook for electric power tools used with an electric power tool comprising a handle and a battery pack detachably mounted to a lower end portion of the handle, the hook being designed to be attached to the electric power tool in the proximity of the lower end portion of the handle and comprising: a ring-shaped slip-off preventing portion having an opening into which the handle is loosely inserted when the battery pack is not attached to the handle, and when the battery pack is attached to the handle, the slip-off preventing portion can be prevented from being pulled out from the handle by the battery pack attached to the handle. It should be noted that the hook may be directly attached to the handle, or as an alternative, the hook may be indirectly attached to the handle through a water proof cover or the like.

According to one specific embodiment of the aforementioned hook, the hook comprising the slip-off preventing portion may be made from a single piece of linear member.

In accordance with a second aspect of the present invention, there is provided an electric power tool comprising a handle, and a battery pack detachably mounted to a lower end portion of the handle, wherein the hook according to the first aspect of the present invention or the one specific embodiment is attached to the electric power tool in the proximity of the lower end portion of the handle while the handle is loosely inserted into the opening of the slip-off preventing portion.

In accordance with a third aspect of the present invention, there is provided an electric power tool comprising: a handle; a battery pack detachably mounted to a lower end portion of the handle; and a water proof cover configured to cover the battery pack over an attachment portion between the lower end portion of the handle and the battery pack, wherein the hook according to the first or the second aspect of the present invention is attached to the water proof cover positioned in the proximity of the lower end portion of the handle while the handle is loosely inserted into the opening of the slip-off preventing portion.

In the electric power tool according to the third aspect of the present invention, as one specific embodiment, the water proof cover may be divided into front and rear divided covers in a direction where the battery pack is slidingly attached to the lower end portion of the handle, and a connecting mechanism may be provided between the two divided covers, the connecting mechanism being operable to move between a connecting position at which the two divided covers are joined together in an attachment state to cover the attachment portion and the battery pack and a disconnecting position at which the connection of the two divided covers are disconnected, and further the hook may be attached to one of the two divided covers.

With these configurations of the hook for electric power tools according to the first aspect of the present invention and the electric power tool according to the second aspect of the present invention, even if the hook incidentally comes off from the proximity of the lower end portion of the handle while being engaged for instance with the belt or the carabiner, because of the battery pack attached to the handle, it is possible to prevent the handle from slipping off from the slip-off preventing portion of the hook. Therefore, if the hook incidentally comes off from the proximity of the lower end portion of the handle, the handle with the battery pack does not slip off from the slip-off preventing portion. This can prevent the fall of the electric power tool while the hook remains engaged with the belt or the carabiner.

With the configuration of the hook for electric power tools according to the one specific embodiment of the present invention, there is no need to manufacture the slip-off preventing portion and other portions separately and to assemble them into the hook using a connecting portion for connecting the slip-off preventing portion and the other portions together. Therefore, as compared with a configuration in which the slip-off preventing portion and other portions are separately formed, the mechanical strength of the hook including the slip-off preventing portion can be enhanced because the hook does not include any connecting portion for connecting the slip-off preventing portion and other portions which may possibly result in a deterioration in the mechanical strength of the hook.

With the configuration of the electric power tool according to the third aspect of the present invention, it is possible to prevent rain water from entering the attachment portion between the lower end portion of the handle and the battery pack and thus the rain water is prevented from flowing toward the battery pack. It is also possible to prevent rain water from entering the inner surface of the battery pack from the outer surface thereof. Therefore, an excellent waterproof performance for protecting the battery pack can be realized.

Further, as the hook for electric power tools is fixed to the water proof cover, it both the water proof cover and the hook to the electric power tool are fixed. In addition, even if the hook for electric power tool comes off from the water proof cover, because of the battery pack covered by the water proof cover and attached to the handle, it is possible to prevent the handle from slipping off from the slip-off preventing portion of the hook. As a result, the electric power tool is not fall while the hook remains engaged with the belt or the carabiner.

With the configuration of the electric power tool according to the one specific embodiment of the third aspect, the two divided covers are joined together by the connecting mechanism to cover the battery pack at the connecting position. Therefore, the hook for electric power tools can be attached to one of the divided covers and both the water proof cover and the hook can be attached to the rechargeable electric power tool.

BRIEF DESCRIPTION OF THE DRAWINGS

To better understand the claimed invention, and to show how the same may be carried into effect, reference will now be made, by way of example only, to the accompanying drawings, in which:

DETAILED DESCRIPTION OF THE EXEMPLARY EMBODIMENT

First Embodiment

Figure 1:
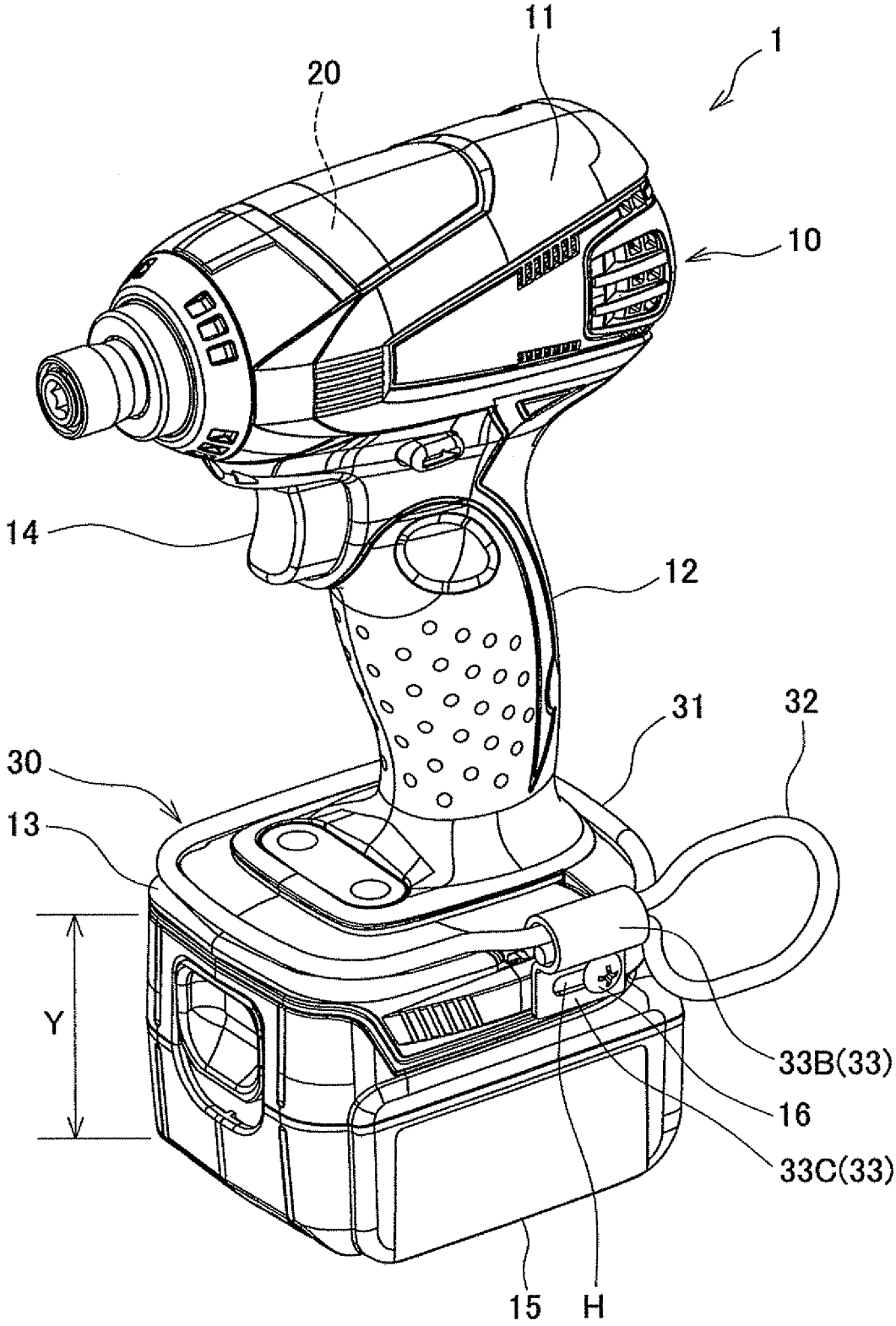
FIG. 1 is a perspective view of an impact driver to which a hook for electric power tools according to one exemplary embodiment of the present invention is attached.

With reference to FIGS. 1 to 7, a first embodiment of the present invention will be described. With reference to FIG. 1, an impact driver 1 includes a housing 10, a hammer case 20, and a hook 30 for electric power tools.

The housing 10 is assembled from right and left housing halves which are made of resin, and includes a body portion 11, a handle portion 12, and a battery pack attachment portion 13. The body portion 11 has a cylindrical shape and extends in a front-back direction of the impact driver 1. A motor (not shown) is disposed in the body portion 11.

The handle portion 12 extends from the body portion 11 in such a manner that the impact driver 1 has a substantially T-shaped configuration as viewed from side. A switch (not shown) with a trigger 14 is disposed inside the handle portion 12. The battery pack attachment portion 13 is positioned at a lower part of the handle portion 12. A battery pack 15 is detachably mounted to the battery pack attachment portion 13. In this embodiment, the battery pack 15 has one or more slide rails (not shown) and the battery pack attachment portion 13 has one or more slide rails (not shown) corresponding to those of the battery pack 15, so that sliding the slide rails of the battery pack 15 along the corresponding slide rails of the battery pack attachment portion 13 causes the battery pack 15 to be attached to the battery pack attachment portion 13 with the both of the slide rails being engaged with each other. The battery pack 15 is a rechargeable power source and supplies electricity to the motor. The impact driver 1 is an example of an electric power tool according to the present invention, and the handle portion 12 is an example of a handle according to the present invention. The battery pack attachment portion 13 is an example of the proximity of a lower end portion of the handle according to the present invention.

The hammer case 20 is made of metal (e.g., aluminum), and is assembled in a front side (i.e., diagonally lower left direction of FIG. 1) of the body portion 11. An impact mechanism is disposed inside the hammer case 20. The impact mechanism converts a rotation of the motor into a rotary impact force and then transmits this rotary impact force to a bit (not shown).

Figure 2:
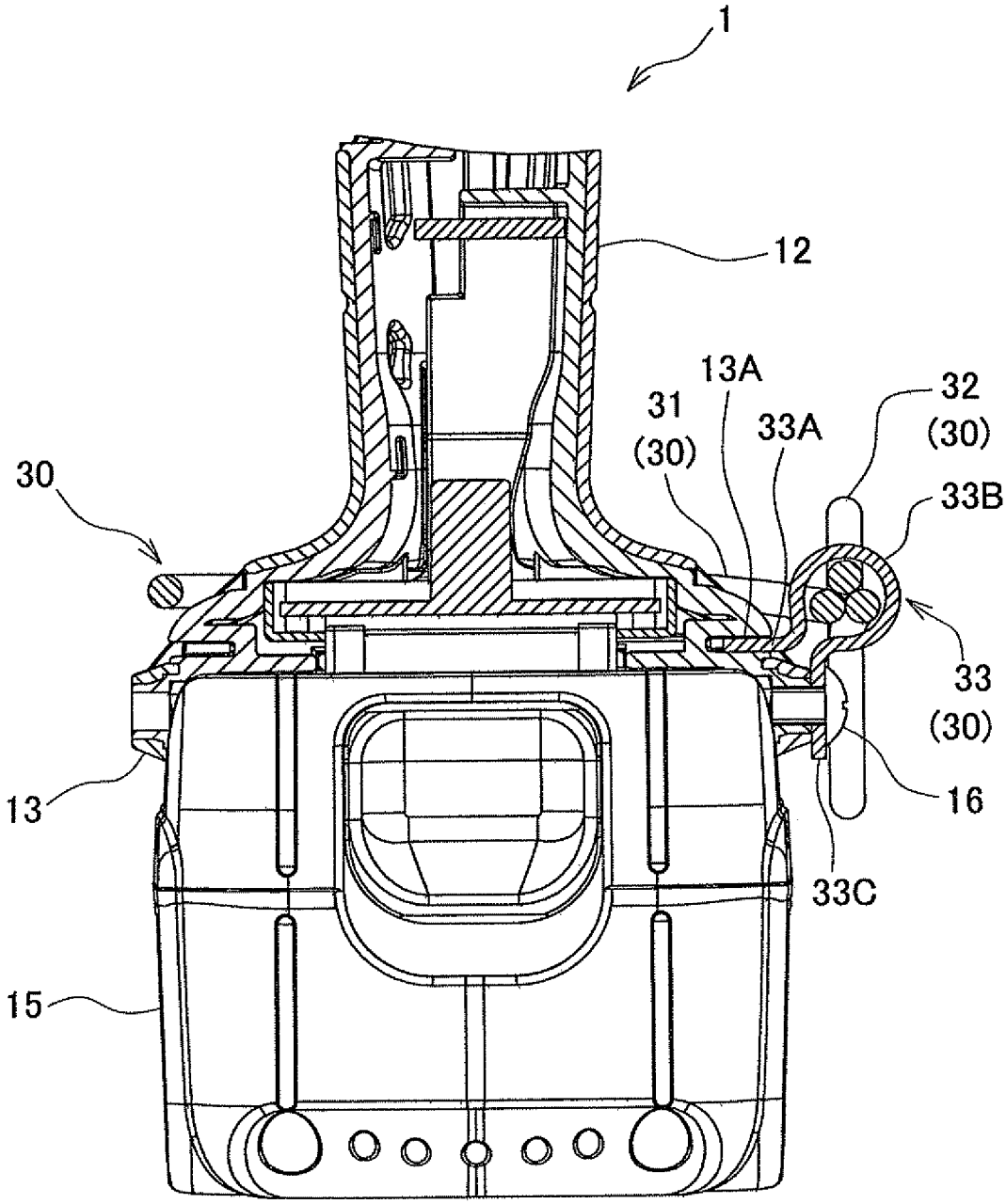
FIG. 2 is an enlarged sectional view partly showing main parts of the impact driver.
Figure 3:
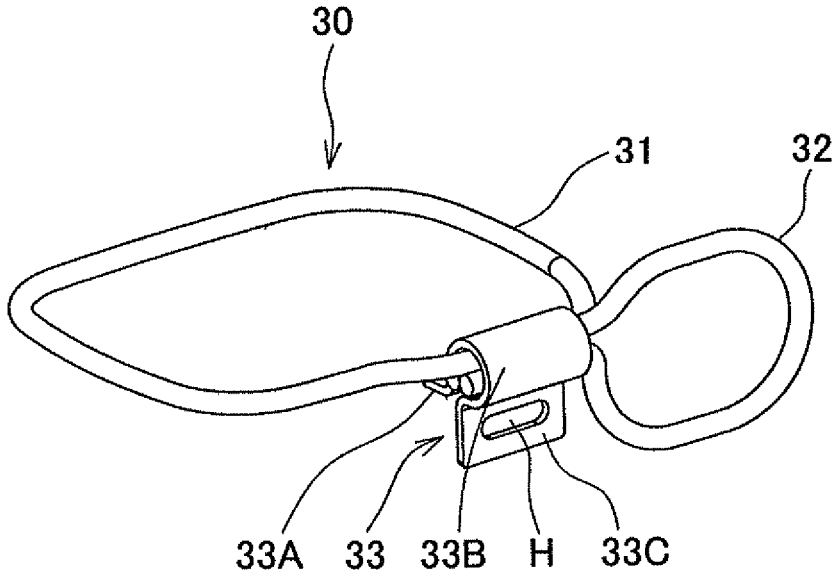
FIG. 3 is a perspective view of the hook.

As seen in FIGS. 1 to 3, the hook 30 for electric power tools includes a slip-off preventing portion 31, a hook body 32, and a joint portion 33. According to this exemplary embodiment, the slip-off preventing portion 31 and the hook body 32 are continuously formed by bending a single piece of wire. This "single piece of wire" is an example of single piece of linear member according to the present invention.

The slip-off preventing portion 31 is shaped as a rectangular ring. This ring-shaped slip-off preventing portion 31 has a size such that when the battery pack 15 has been detached from the battery pack attachment portion 13, the battery pack attachment portion 13 can be inserted into an opening of the slip-off preventing portion 31. The hook body 32 is shaped as an oval ring. As described later, the hook body 32 is hanged from a carabiner 40 that is attached to a waist belt of a worker (see FIG. 7).

The joint portion 33 is configured to be attached to the battery pack attachment portion 13 while connecting the slip-off preventing portion 31 and the hook body 32 by welding. The joint portion 33 is formed from a plate-like steel plate or iron plate and made by bending this plate-like member. The joint portion 33 includes a protruding strip 33A, a weldable tubular portion 33B, and a battery pack attachment portion fixing strip 33C.

The protruding strip 33A is formed into a flat plate shape using a distal end portion of the plate-like member. The protruding strip 33A is inserted into a corresponding slit-hole 13A (see FIG. 2), which is formed laterally in the right side surface of the battery pack attachment portion 13 as viewed from the front of the impact driver 1. When the protruding strip 33A is inserted into the slit-hole 13A, the battery pack attachment portion fixing strip 33C can be positioned parallel to the right side outer surface of the battery pack attachment portion 13.

The weldable tubular portion 33B is formed from the plate-like member and made by bending a center part of the plate-like member into a tubular shape. As seen in FIGS. 1 to 3, the weldable tubular portion 33B partly sheaths the slip-off preventing portion 31 and the hook body 32. Further, the slip-off preventing portion 31 and the hook body 32 are joined to the weldable tubular portion 33B by welding.

The battery pack attachment portion fixing strip 33C is configured to be attached to the right side outer surface of the battery pack attachment portion 13, and is formed into a flat plate shape using a rear end portion of the plate-like member. As seen in FIGS. 1 and 3, the battery pack attachment portion fixing strip 33C has an oblong hole H. The oblong hole H is laterally extends in a transverse direction of the battery pack attachment portion fixing strip 33C. When the hook 30 is attached to the battery pack attachment portion 13, the battery pack attachment portion fixing strip 33C is positioned parallel to the right side outer surface of the battery pack attachment portion 13, and thereafter, a screw 16 is inserted through the oblong hole H and threadedly engaged with the battery pack attachment portion 13.

Figure 4:
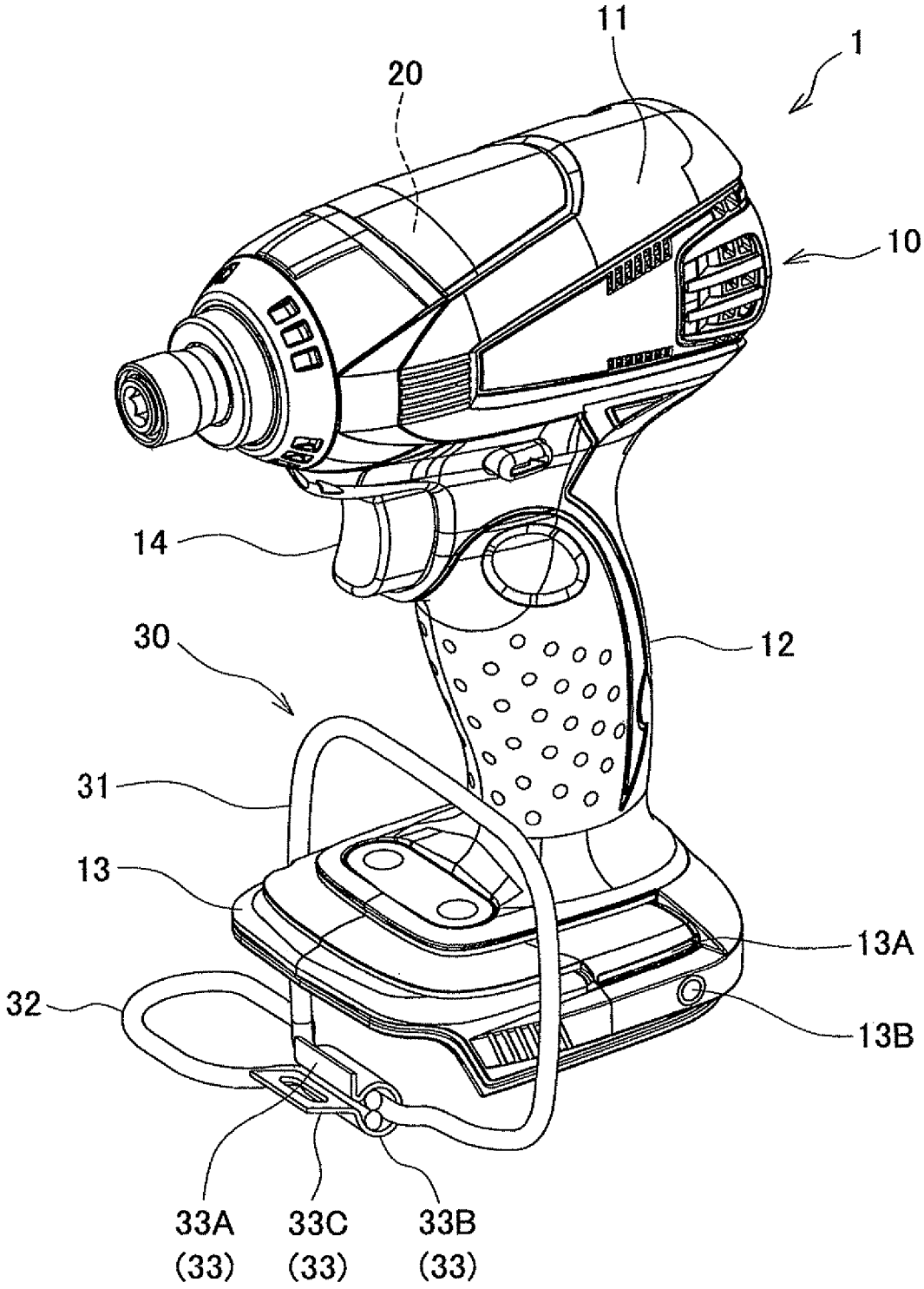
FIG. 4 is an explanatory view illustrating a state in which a battery pack attachment portion is loosely inserted into an opening of a slip-off preventing portion.

Next, with reference to FIG. 1 and FIGS. 4 to 6, the operation of the worker will be described when he engages the hook 30 for electric power tools with the battery pack attachment portion 13 of the impact driver 1. As best seen in FIG. 4, the worker holds the hook 30 in an upstanding posture such that the hook body 32 and the joint portion 33 are positioned at the lower left side of the battery pack attachment portion 13 as viewed from the front side of the impact driver 1. Thereafter, the worker inserts the slip-off preventing portion 31 of the hook 30 over the battery pack attachment portion 13 from the front side of the battery pack attachment portion 13 to a position just in front of the handle portion 12. In this case, the battery pack 15 as shown in FIG. 1 is removed in advance from the battery pack attachment portion 13.

Figure 5:
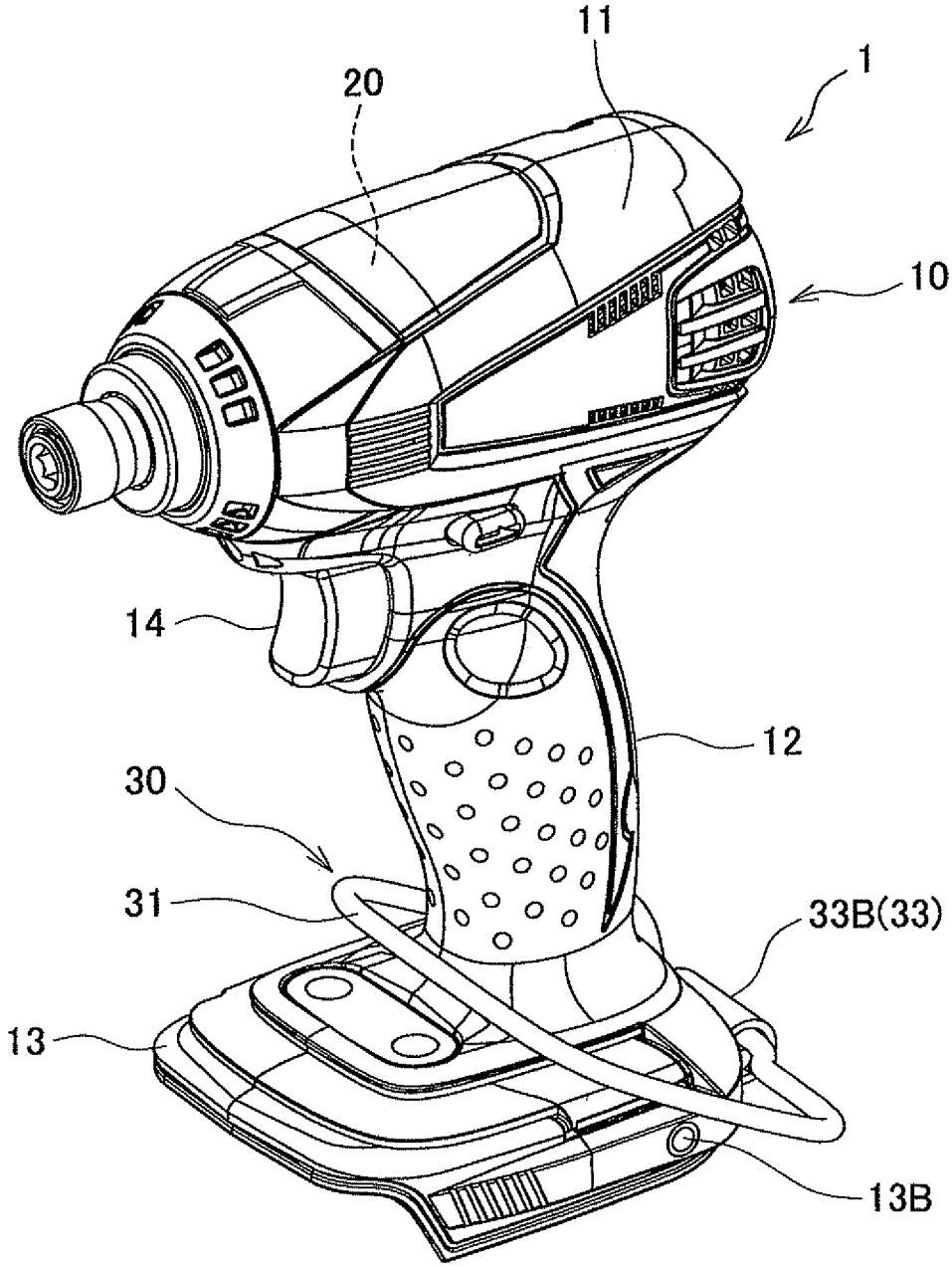
FIG. 5 is an explanatory view illustrating a state in which the slip-off preventing portion is tilted and passed through the battery pack attachment portion.

Thereafter, the worker tilts the hook 30 from the upstanding posture in such a manner that the slip-off preventing portion 31 is passed through the battery pack attachment portion 13 and the lower end portion of the handle portion 12, to thereby engage one side of the rectangular ring-shaped slip-off preventing portion 31 with a basal portion of the handle portion 12 as shown in FIG. 5.

Figure 6:
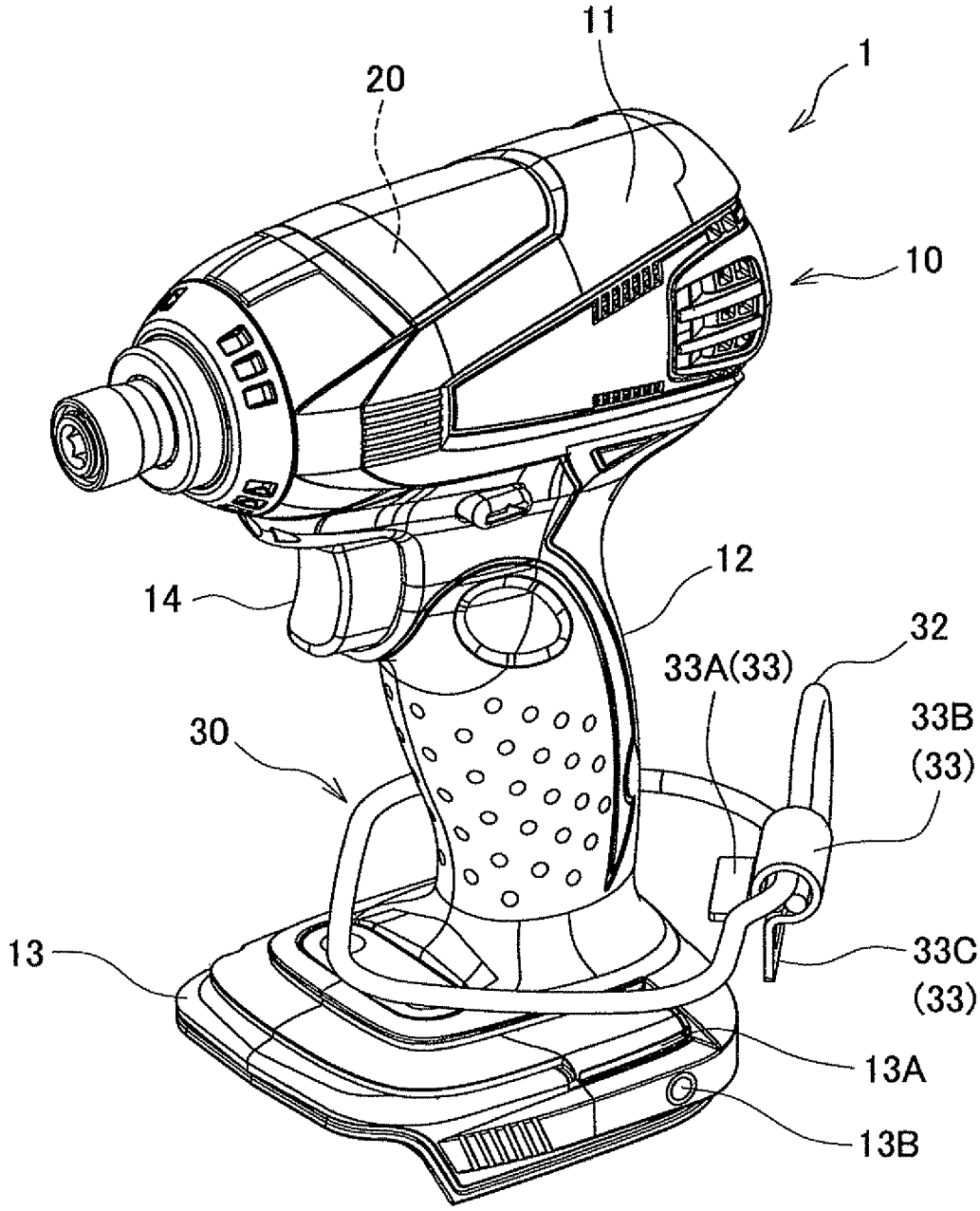
FIG. 6 is an explanatory view illustrating a state in which the hook is rotated horizontally to move a hook body and a joint portion.

The worker then horizontally rotates the hook 30 in a clockwise direction along the handle portion 12, so that, as best seen in FIG. 6, the hook body 32 and the joint portion 33 are moved to the right side of the battery pack attachment portion 13 as viewed from the front side of the impact driver 1.

The worker further inserts the protruding strip 33A (see FIG. 6) into the corresponding slit-hole 13A (see FIG. 6), so that, as described above, the battery pack attachment portion fixing strip 33C is positioned parallel to the right side outer surface of the battery pack attachment portion 13. As seen in FIGS. 1 and 6, the worker then inserts the screw 16 through the oblong hole H and threadedly engages the screw 16 with a screw hole 13B of the battery pack attachment portion 13. Accordingly, the hook 30 receives the lower end portion of the handle portion 12 and attached to the battery pack attachment portion 13. After the hook 30 is attached to the handle portion 12, as seen in FIG. 1, the worker attaches the battery pack 15 to the battery pack attachment portion 13.

As described below, the worker engages the hook 30 with the carabiner 40. Namely, the worker holds the handle portion 12 by one hand, and positions the impact driver 1 such that the housing 10 faces downward and the battery pack 15 faces upward. Thereafter, the worker brings the hook body 32 into pressingly contact with a gate member 41 (see FIG. 7) while the rear surface of the impact driver 1 faces the to worker. Accordingly, the gate member 41 is bent inwardly to open an end portion 42A of a hook 42 (see FIG. 7).

When the worker inserts the end portion 42A into the hook body 32, the gate member 41 returns to the original position, i.e., a previous state before the hook body 32 is pressed against the gate member 41, by the urging force of a spring (not shown). Therefore, the end portion 42A is closed and the hook body 32 is engaged with the hook 42 of the carabiner 40.

According to this exemplary embodiment, as described below, it is possible to prevent the impact driver 1 from falling from the carabiner 40, even if the screw 16 comes off from the screw hole 13B while the hook body 32 remains engaged with the hook 42, and thus the hook 30 for electric power tools is disengaged from the battery pack attachment portion 13.

Figure 7:
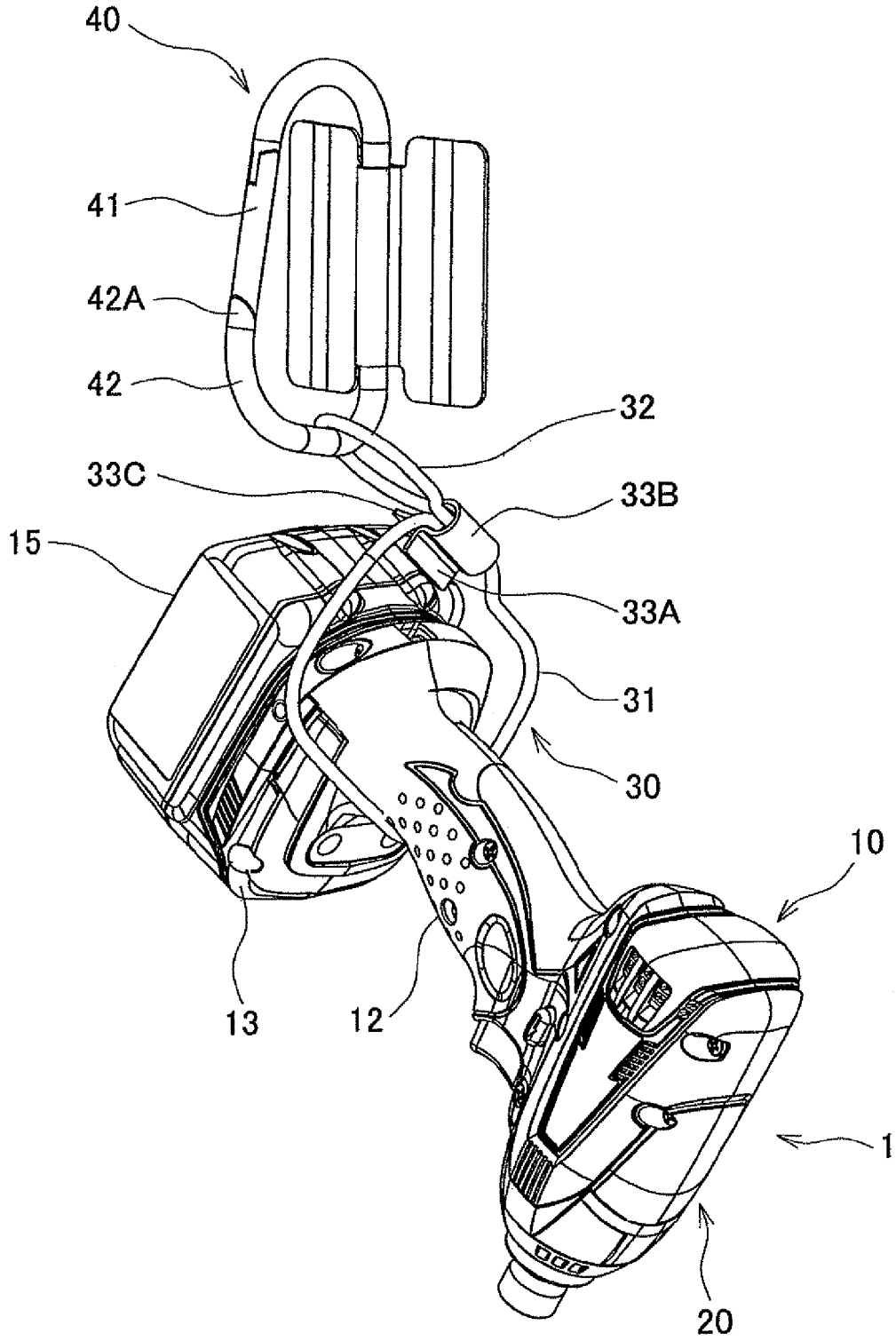
FIG. 7 is an explanatory view illustrating a state in which a battery pack attachment portion fixing strip comes off from the battery pack attachment portion and the impact driver is retained by the slip-off preventing portion of the hook.

FIG. 7 shows a state in which the screw 16 comes off from the screw hole 13B and the protruding strip 33A is pulled out from the slit-hole 13A, so that the battery pack attachment portion fixing strip 33C is disengaged from the battery pack attachment portion 13. In this state, the battery pack attachment portion 13 with the battery pack 15 can be prevented from slipping off from the slip-off preventing portion 31, and the slip-off preventing portion 31 is trapped at the basal portion of the handle portion 12. This is because, as compared with the height Y of the battery pack 15 (see FIG. 1) in a direction parallel to the vertical direction of the impact driver 1, the size of each side which constitutes the rectangular ring-shaped slip-off preventing portion 31 is smaller, and the battery pack 15 prevents the slip-off preventing portion 31 from coming off from the battery pack attachment portion 13.

As seen in FIG. 7, according to the hook 30 as described in this embodiment in which the slip-off preventing portion 31 and the hook body 32 are joined together by welding, while the hook body 32 is engaged with the hook 42, the impact driver 1 can be retained by the slip-off preventing portion 31 so as not to fall from the carabiner 40.

Advantageous Effects of First Embodiment

According to the hook 30 for electric power tools and the impact driver 1 equipped with the hook 30 as described above in the exemplary embodiment of the present invention, the slip-off preventing portion 31 is integrally provided with the hook body 32, and in a state where the handle portion 12 is loosely inserted into the the hook 30, it is possible to prevent the slip-off preventing portion 31 from coming off from the battery pack attachment portion 13 because of the battery pack 15 attached to the battery pack attachment portion 13.

Therefore, as described above and as shown in FIG. 7, even if the battery pack attachment portion fixing strip 33C comes off from the battery pack attachment portion 13 while the hook body 32 of the hook 30 for electric power tools is engaged with the hook 42, it is possible to prevent the battery pack attachment portion 13 with the battery pack 15 from slipping off from the slip-off preventing portion 31.

Therefore, even if the battery pack attachment portion fixing strip 33C incidentally comes off from the battery pack attachment portion 13, the battery pack attachment portion 13 with the battery pack 15 does not slip off from the slip-off preventing portion 31. This can prevent the fall of the impact driver 1 from the carabiner 40 while the hook body 32 remains engaged with the hook 42.

Further, according to the hook 30 for electric power tools as described above, the slip-off preventing portion 31 and the hook body 32 are continuously formed by bending a single piece of wire. Therefore, there is no need to manufacture the slip-off preventing portion 31 and the hook body 32 separately and to assemble them into the hook 30 using a connecting portion (e.g., welded portion) for connecting the slip-off preventing portion 31 and the hook body 32 together. Therefore, as compared with a configuration in which the slip-off preventing portion 31 and the hook body 32 are separately formed, the mechanical strength of the hook 30 including the slip-off preventing portion 31 can be enhanced because the hook 30 does not include a welded portion which may possibly results in a deterioration in the mechanical strength of the hook.

Second Embodiment

With reference to FIGS. 8 to 14, a second embodiment of the present invention will be described. In this embodiment, parts similar to those previously described in the first embodiment are denoted by the same reference numerals, and detailed description thereof will be omitted. As seen in FIGS. 8 to 13, an impact driver 1A further includes a water proof cover 50, and a hook 35 for electric power tools. The impact driver 1A is an example of an electric power tool according to the present invention.

Figure 10:
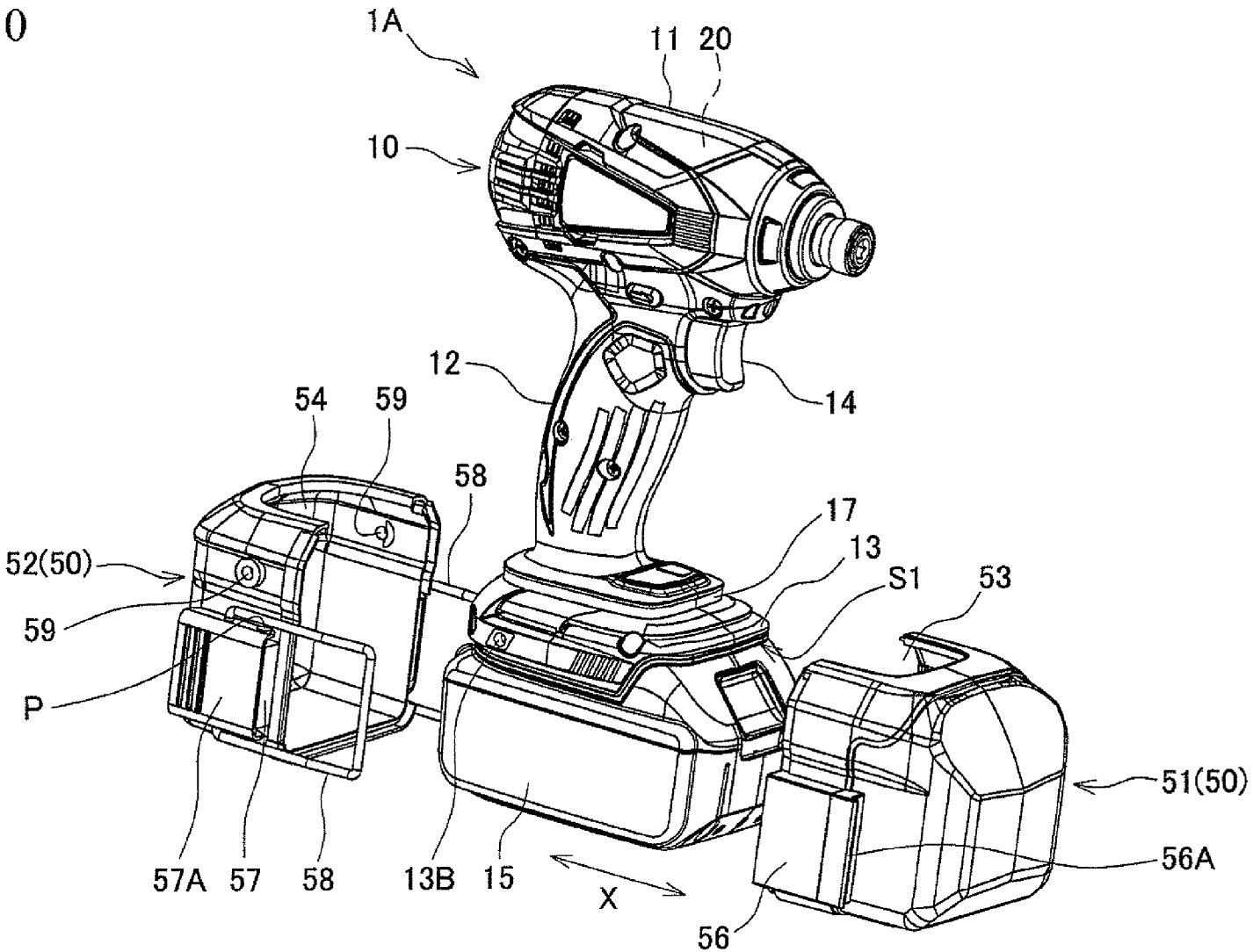
FIG. 10 is an exploded perspective view of a water proof cover before attachment to the impact driver.
Figure 11:
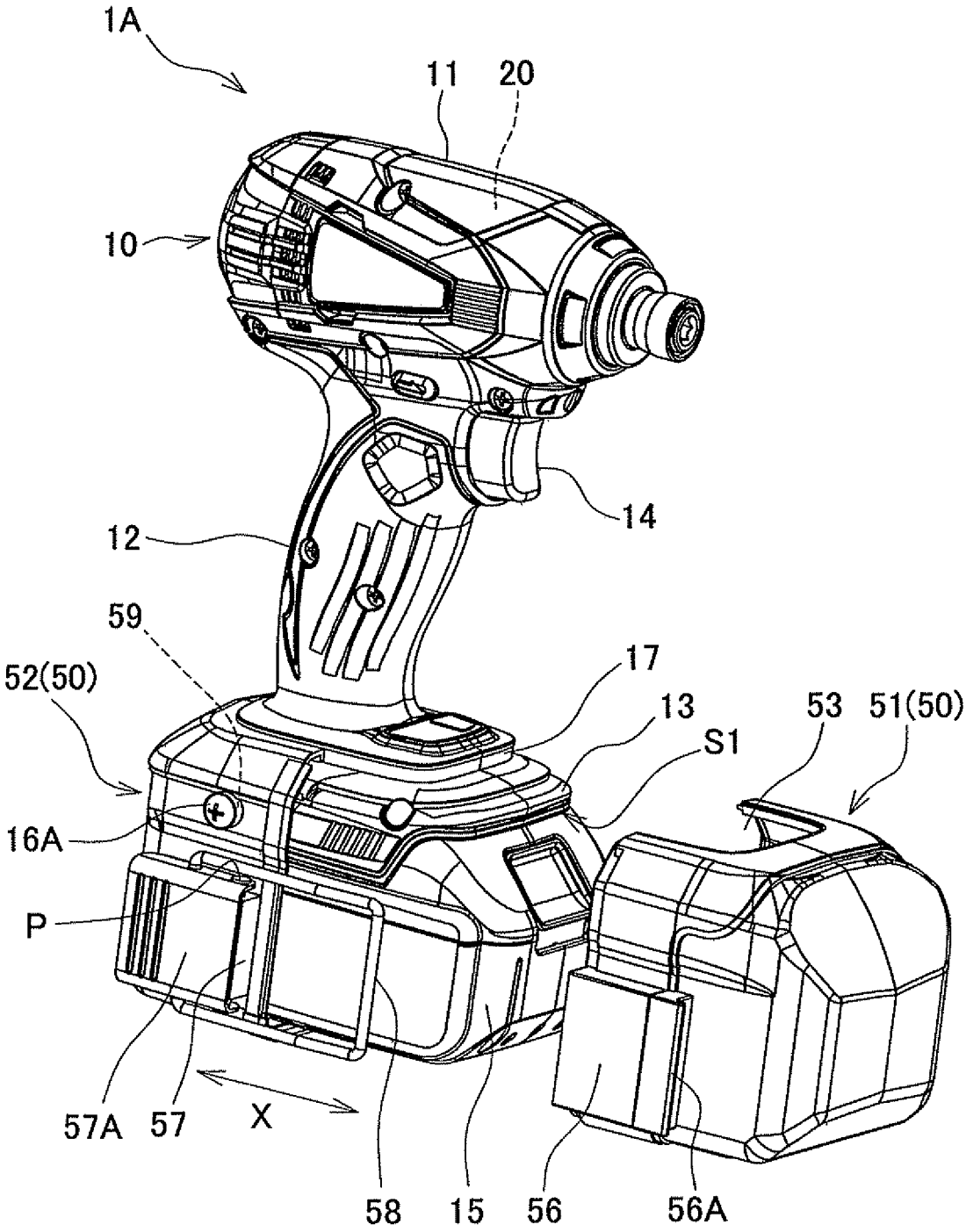
FIG. 11 is a perspective view showing a state in which a rear-side cover is attached to the battery pack attachment portion of the impact driver by threadedly inserting a screw through the rear-side cover into the battery pack attachment portion.
Figure 14:
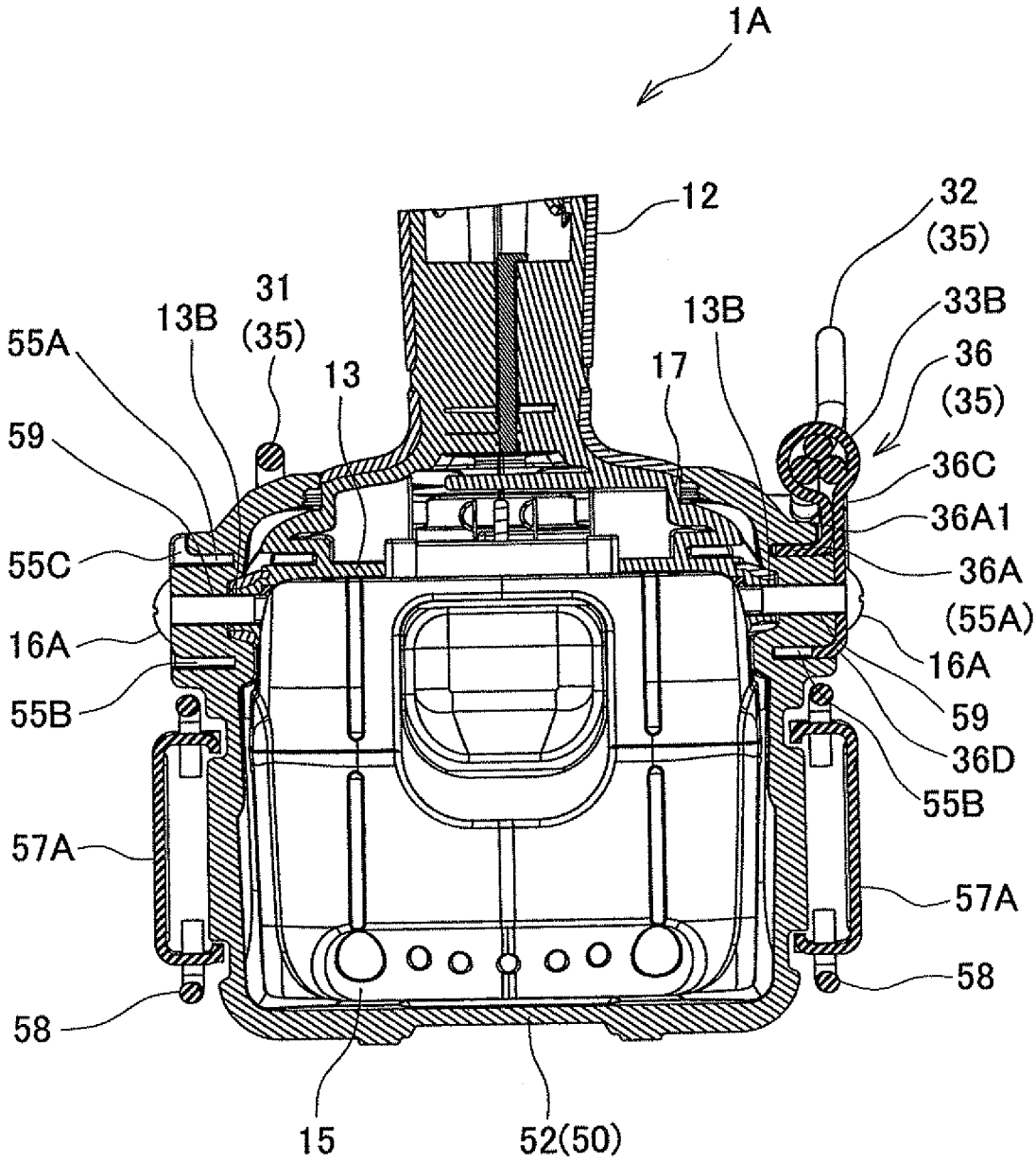
FIG. 14 is an enlarged sectional view partly showing main parts of the impact driver, in which the hook for electric power tools is fixed to the water proof cover.

As best seen in FIGS. 10 and 11, the battery pack attachment portion 13 has a sealing surface 17. Further, as best seen in FIGS. 10 and 14, a screw hole 13B is formed in the left side outer surface of the battery pack attachment portion 13 as viewed from the front side of the battery pack attachment portion 13. Another screw hole 13B is also formed in the right side outer surface of the battery pack attachment portion 13. It is to be noted that the left side of FIG. 14 indicates the left side of the battery pack attachment portion 13 as viewed from the front side of the battery pack attachment portion 13, and the right side of FIG. 14 indicates the right side of the battery pack attachment portion 13 as viewed from the front side thereof.

Figure 8:
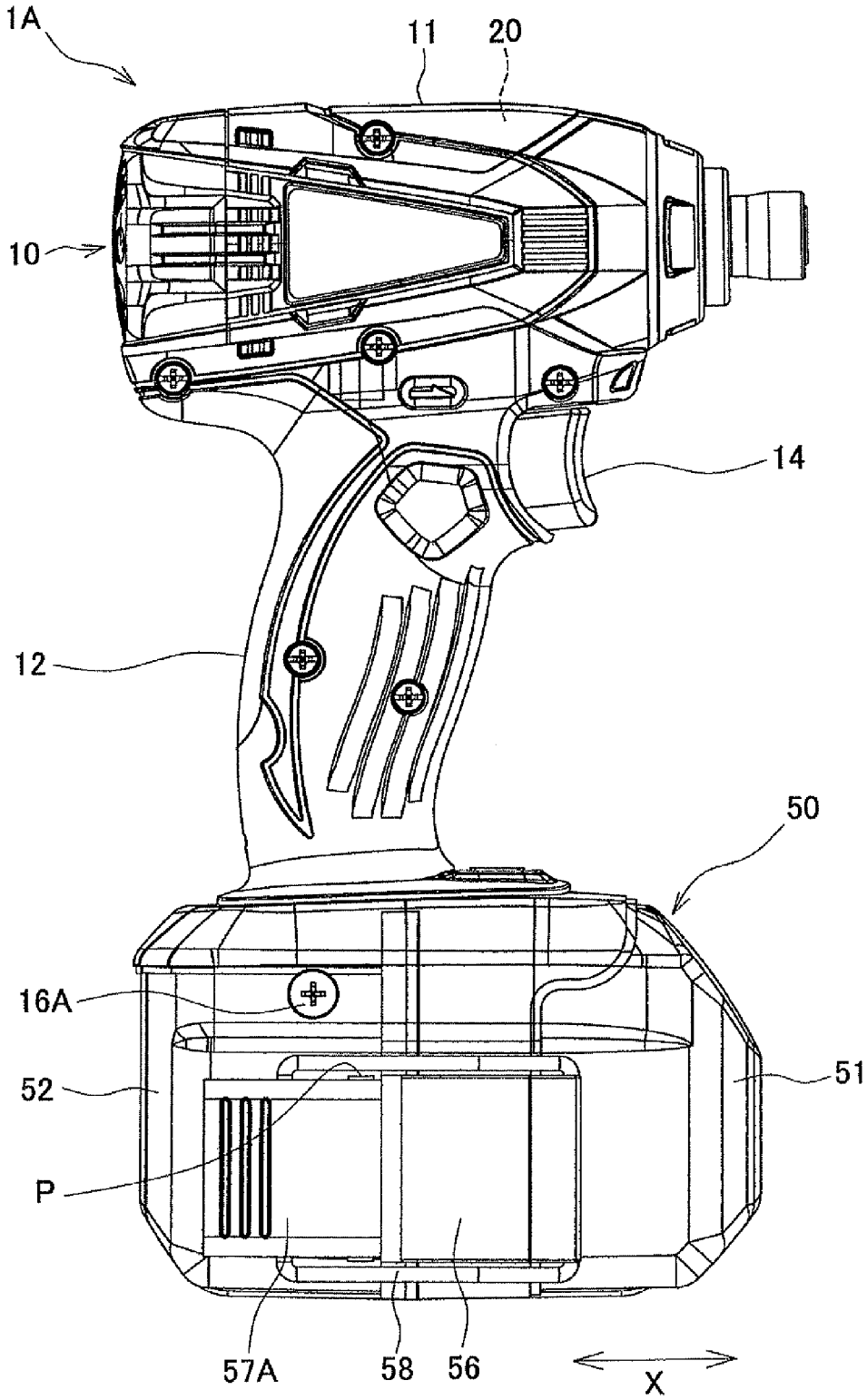
FIG. 8 is a left side elevation of the impact driver to which a water proof cover according to one exemplary embodiment of the present invention is attached.
Figure 9:
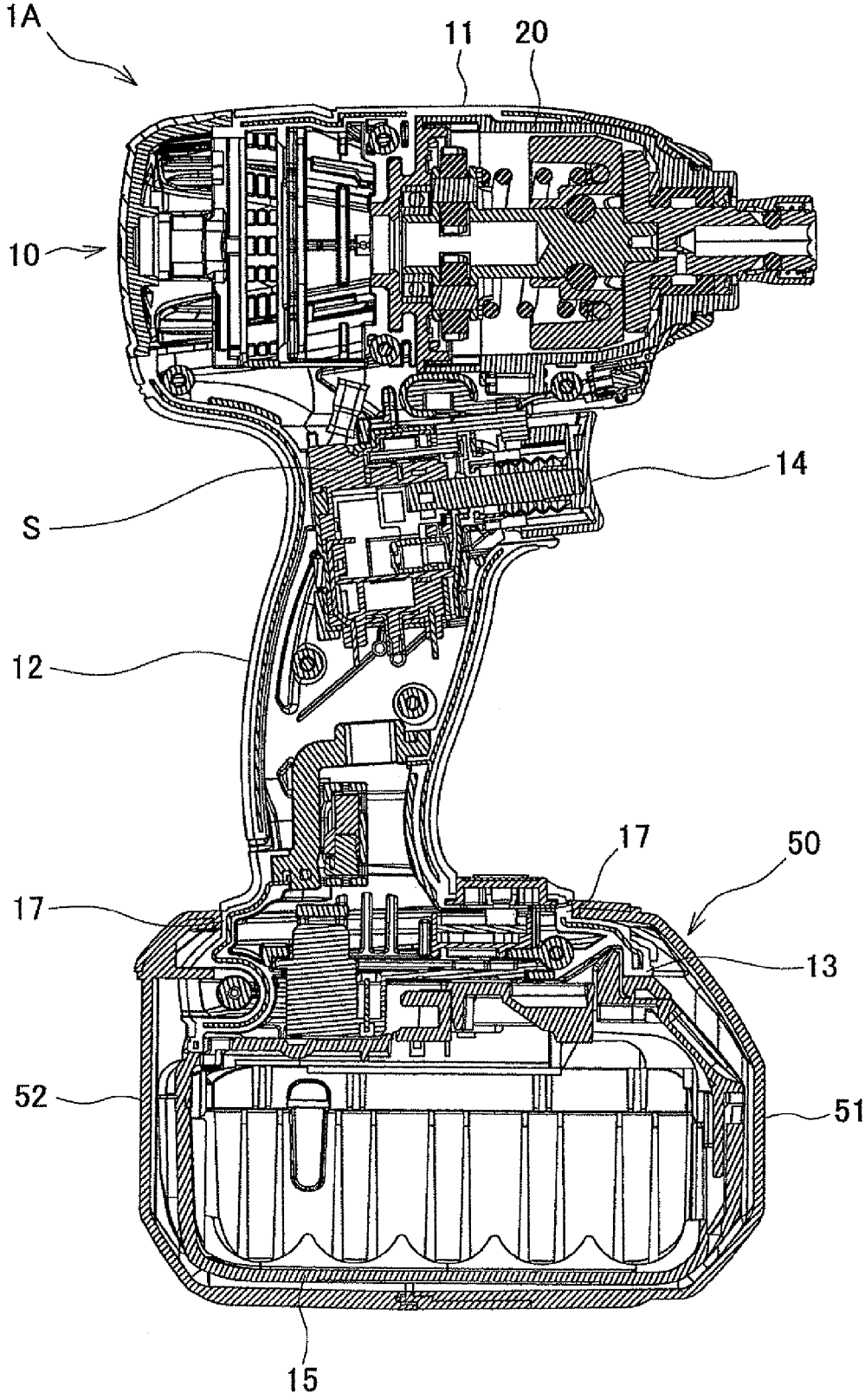
FIG. 9 is a sectional view showing main parts of the impact driver.

The water proof cover 50 is in the shape of a bag having an opening at its upper surface. The water proof cover 50 is made of transparent plastic material. The water proof cover 50 is used for covering an outer periphery of the battery pack 15 and a gap S1 (see FIGS. 10 and 11) at the attachment portion between the battery pack 15 and the battery pack attachment portion 13. Since the water proof cover 50 is transparent, it is possible to check, from the outside of the water proof cover 50, whether there is any ingress of rain water or the like into the water proof cover 50. FIG. 8 shows a state in which the water proof cover 50 covers the outer periphery of the battery pack 15 and the gap S1 (hereinafter referred to as an attachment state). As seen in FIG. 10, the water proof cover 50 is configured to be dividable into two covers, that is, a front-side cover 51 and a rear-side cover 52, in a direction (slide-attachment direction X) where the battery pack 15 is slidingly attached to the battery pack attachment portion 13. It is to be noted that the left side of FIG. 8 indicates the front side in the slide-attachment direction X, and the right side of FIG. 8 indicates the rear side in the slide-attachment direction X. Both of the front-side cover 51 and the rear-side cover 52 are one example of divided covers according to the present invention.

Figure 13:
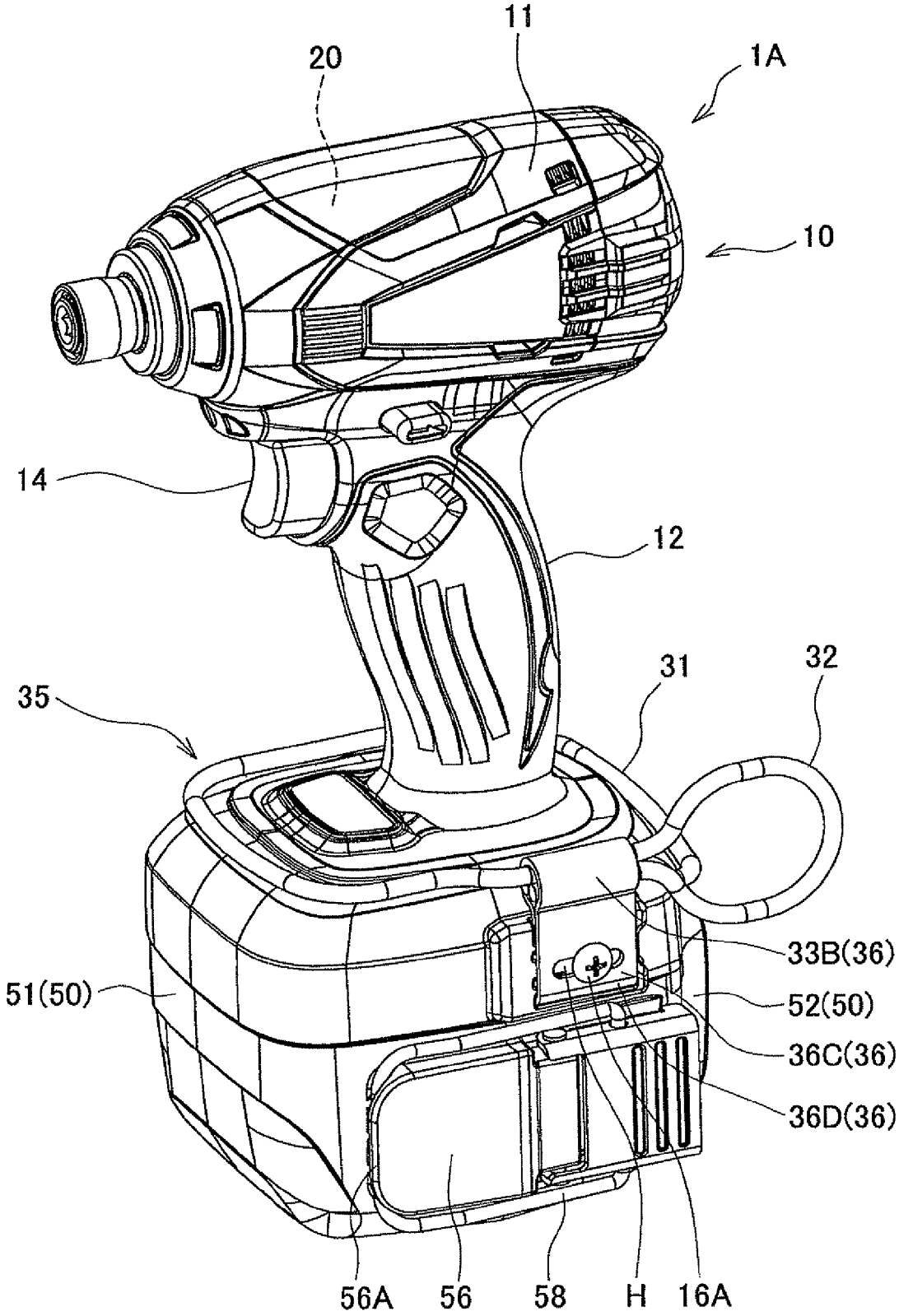
FIG. 13 is a perspective view of the whole impact driver with the hook for electric power tools being fixed to the water proof cover.

As seen in FIGS. 10 and 13, a latching projection 56 is formed on each of the right and left side outer surfaces of the front-side cover 51. At each rear end surface of the latching projection 56, a latching engagement protrusion 56A extends rearward along the slide-attachment direction X. Provided at each of the right side outer surface and the left side outer surface of the rear-side cover 52 is a rotary member attachment portion 57. The rotary member attachment portion 57 protrudes from the outer surface of the rear-side cover 52, and a rotary member 57A is rotatably supported on the rotary member attachment portion 57 through a connecting pin P (see FIG. 8). Insertion holes (not shown) are formed in the upper surface and the lower surface of the rotary member 57A, so that both end portions of an open annular ring member 58 can be inserted into the insertion holes.

As best seen in FIGS. 10 and 14, a through hole 59 is formed in each of the right and left side outer surfaces of the rear-side cover 52. It is to be noted that the left side of FIG. 14 indicates the left side of the rear-side cover 52, and the right side of FIG. 14 indicates the right side of the rear-side cover 52. Further, as seen in FIG. 14, two engagement grooves 55A, 55B and a cutout portion 55C are formed in the right side outer surface and the left side outer surface of the rear-side cover 52, respectively. The cutout portion 55C is formed by cutting the outer side surface of the rear-side cover 52 along its vertical direction (e.g., in the vertical direction of FIG. 14). The cutout portion 55C has a horizontally long shape and partly communicates with the upper surface of the engagement groove 55A.

As seen in FIGS. 13 and 14, the hook 35 for electric power tools has a joint portion 36. The joint portion 36 is configured to be fixed to the rear-side cover 52 and formed by bending a plate-like member which is made of steel or iron. The joint portion 36 includes a first engagement projection 36A, a weldable tubular portion 33B, a rear-side cover fixing strip 36C, and a second engagement projection 36D. The first engagement projection 36A is provided by a horizontal portion of an inverted L-shaped member; the inverted L-shaped member is formed by bending the front end side of the plate-like member and includes the horizontal portion as the first engagement projection 36A and a vertical portion 36A1. The first engagement projection 36A is fitted into the engagement groove 55A formed in the right side outer surface of the rear-side cover 52. When the first engagement projection 36A is fitted into the engagement groove 55A, the vertical portion 36A1 is supported by the cutout portion 55. The rear-side cover fixing strip 36C is provided by a vertical portion of an inverted L-shaped member; the inverted L-shaped member is formed by bending the rear end side of the plate-like member and includes the vertical portion as the rear-side cover fixing strip 36C and a horizontal portion which provides the second engagement projection 36D. The second engagement projection 36D is fitted into the engagement groove 55B formed in the right side outer surface of the rear-side cover 52.

In this second embodiment, the battery pack attachment portion 13 is inserted into the slip-off preventing portion 31 in the same way as that of the first embodiment, and thereafter the front-side cover 51 and the rear-side cover 52 are joined together into the attachment state. The manner of assembling the front-side cover 51 and the rear-side cover 52 into the attachment state will be described below in detail. It is to be noted that in FIGS. 8, 9 and 12, the hook 35 for electric power tools attached to the water proof cover 50 is omitted, and in FIGS. 10 and 11, a state where the battery pack attachment portion 13 is inserted into slip-off preventing portion 31 is not shown. FIGS. 10 and 11 shows that the rear-side cover 52 is slid until an opening portion 54 of the rear-side cover 52 is brought into abutment at its peripheral end portion against the front-side end surface of the sealing surface 17 in the slide-attachment direction X. At a position in which the peripheral end portion of the opening portion 54 abuts on the front-side end surface of the sealing surface 17, the through hole 59 overlaps with the screw hole 13B so that a screw 16A can be inserted into the through hole 59 and threadedly engageable with the screw hole 13B. Therefore, as best seen in FIG. 11, the left side inner surface of the rear-side cover 52 can be threadedly fixed to the battery pack attachment portion 13.

As best seen in FIG. 14, before the right side inner surface of the rear-side cover 52 is threadedly fixed to the battery pack attachment portion 13, the joint portion 36 of the hook 35 is mounted such that the first engagement projection 36A is fitted into the engagement groove 55A, the vertical portion 36A1 is supported by the cutout portion 55C, and the second engagement projection 36D is fitted into the engagement groove 55B. Thereby, the rear-side cover fixing strip 36C abuts on the right side outer surface of the rear-side cover 52 while the oblong hole H faces the through hole 59A. Thereafter, as seen in FIGS. 13 and 14, the screw 16A is inserted into the oblong hole H and the through hole 59 and then threadedly engaged with the screw hole 13B. Accordingly, while the right side inner surface of the rear-side cover 52 is threadedly fixed to the battery pack attachment portion 13, the rear-side cover fixing strip 36C of the joint portion 36 can be threadedly fixed to the right side outer surface of the rear-side cover 52. Therefore, the hook 35 can be fixed to the right side outer surface of the battery pack attachment portion 13 through the joint portion 36 while the handle portion 12 is inserted into the slip-off preventing portion 31. Further, this can prevent the rear-side cover 52 from coming off from the battery pack attachment portion 13.

Figure 12:
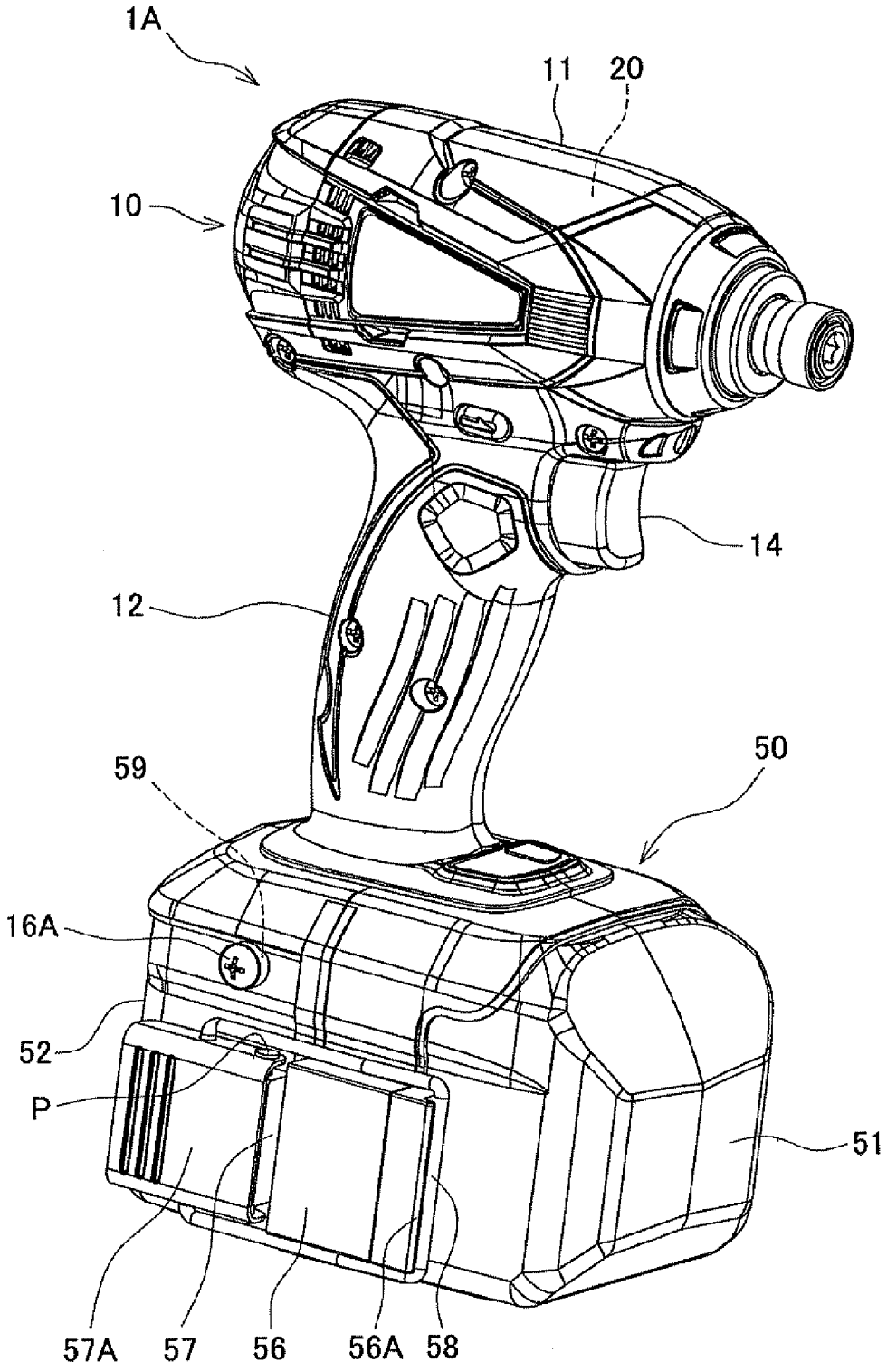
FIG. 12 is a perspective view of the whole impact driver with the water proof cover being attached to the impact driver.

Next, the front-side cover 51 is slid until an opening portion 53 of the front-side cover 51 is brought into abutment at its peripheral end portion against the rear-side end surface of the sealing surface 17 in the slide-attachment direction X. Thereafter, the user engages the open annular ring member 58 extending from the rotary member 57A with respect to the latching engagement protrusion 56A (see FIG. 12). In this state, as shown in FIG. 12, the closed loop portion of the open annular ring member 58 pulls the latching projection 56 toward the rear-side cover 52, so that the front-side cover 51 closely contacts with the rear-side cover 52 and the front-side cover 51 and the rear-side cover 52 are joined together. Accordingly, in this attachment state, the peripheral edge portions of both of the opening portions 53, 54 are closely in contact with the entire circumference of the sealing surface 17. As seen in FIGS. 8 and 12, the position at which the front-side cover 51 and the rear-side cover 52 are joined together is an example of a connecting position according to the present invention. The latching projection 56, the latching engagement protrusion 56A, the rotary member attachment portion 57, the rotary member 57A, and the open annular ring member 58 constitute a connecting mechanism according to the present invention.

On the contrary, in order to disengage the front-side cover 51 and the rear-side cover 52, the user rotates the rotary member 57A in a direction remote from the outer side surface of the rear-side cover 52, so that the engagement of the open annular ring member 58 relative to the latching engagement protrusion 56A can be disengaged. Thereafter, the user moves the front-side cover 51 such that the peripheral edge portions of the opening portion 53 slides backward in the slide-attachment direction X along the sealing surface 17. Accordingly, as seen in FIG. 11, the engagement between the front-side cover 51 and the rear-side cover 52 can be disengaged. As best seen in FIG. 11, the position at which the front-side cover 51 and the rear-side cover 52 are disengaged from each other is an example of a disconnecting position according to the present invention.

Advantageous Effects of Second Embodiment

According to the impact driver 1A in this second embodiment, the front-side cover 51 and the rear-side cover 52 are joined together to cover the outer periphery of the battery pack 15 and the gap S1 at the attachment portion between the battery pack 15 and the battery pack attachment portion 13. Therefore, an excellent waterproof performance for protecting the battery pack 15 can be realized. Further, the water proof cover 50 consisting of the front-side cover 51 and the rear-side cover 52 as well as the hook 35 for electric power tools can be attached to the impact driver 1A.

In addition, even if the joint portion 36 incidentally comes off from the water proof cover 50 (i.e., rear-side cover 52), the battery pack attachment portion 13 to which the battery pack 15 covered by the front-side cover 51 and the rear-side cover 52 has been attached does not slip off from the slip-off preventing portion 31. Therefore, as with the first embodiment, it is possible to prevent the fall of the impact driver 1A from the carabiner 40 while the hook body 32 remains engaged with the hook 42.

Although the present invention has been described with reference to the above exemplary embodiment, the present invention is not limited to the above specific embodiment and various changes and modifications may be made without departing from the scope of the appended claims. For example, in the above exemplary embodiment, the slip-off preventing portion 31 and the hook body 32 are continuously formed by bending a single piece of wire. However, the present invention is not limited to this specific embodiment, and the slip-off preventing portion and the hook body may be formed by bending a belt-like member such as a belt-like metal plate.

In the above exemplary embodiment, the slip-off preventing portion 31 and the hook body 32 are joined together by welding. However, the present invention is not limited to this specific embodiment, and the slip-off preventing portion 31 and the hook body 32 may be joined together by crimping the joint portion 33.

In the above exemplary embodiment, the slip-off preventing portion 31 and the hook body 32 are formed using a single piece of wire. However, the present invention is not limited to this specific embodiment, and the slip-off preventing portion 31 and the hook body 32 may be formed separately and then continuously joined for instance by welding. Further, in the above exemplary embodiment, the hook body 32 is formed as an oval-shaped ring. However, the present invention is not limited to this specific embodiment, and the hook body may be a non-ring shape such as a hook shape.

Further, in the above exemplary embodiment, the hook 30 is attached to the right side outer surface of the battery pack attachment portion 13 as viewed from the front side of the impact driver 1. However, the hook 30 may be attached to the left side outer surface of the battery pack attachment portion 13. Further, unlike the second embodiment, the water proof cover for covering the battery pack 15 may be formed as an integral and undividable box-shaped cover. Furthermore, in the first embodiment, the hook 30 has been described as being attached to the impact driver 1. However, the present invention is not limited to this specific embodiment, and the hook 30 may be attached to another electric power tool, such as a driver other than impact drivers and a drill.

What is claimed is:

1. A hook and power tool combination comprising:

a power tool having a handle with a battery pack attachment portion configured to attach to a removable battery pack and a removable battery pack;

the battery pack attachment portion of the power tool having a first cross-sectional height that is a maximum cross-sectional height of the battery pack attachment portion along a longitudinal axis of the handle;

the removable battery pack having a second cross-sectional height that is a maximum cross-sectional height of the battery along the longitudinal axis of the handle, the second height being larger than the first height; and a hook configured to attach to the handle along the battery pack attachment portion, wherein the hook has a ring-shaped slip-off preventing portion having a diameter larger than the first height and wherein the combined height of the first and second heights is such that the handle can be inserted through the ring-shaped slip-off preventing portion when the battery pack is not attached to the handle, and when the battery pack is attached to the handle, the slip-off preventing portion is prevented from being pulled out from the handle by the battery pack attached to the handle.

2. The hook and power tool combination according to claim 1, wherein the slip-off preventing portion is made from a single piece of linear member.

3. The hook and power tool combination according to claim 1, wherein the slip-off preventing portion is shaped as a rectangular ring, and wherein the rectangular ring has a size such that when the battery pack is not attached to the lower end portion of the handle, the lower end portion can be inserted into the rectangular ring.

4. The hook and power tool combination according to claim 2, wherein the hook comprises the slip-off preventing portion and a hook body engageable with a belt of a worker, and the slip-off preventing portion and the hook body are made from the single piece of linear member and connected to each other.

5. The hook and power tool combination according to claim 2, wherein the liner member is a wire.

6. The hook and power tool combination according to claim 4, wherein the hook further comprises a joint portion, at which the slip-off preventing portion and the hook body are welded together and by which the hook is attached to the lower end portion of the handle.

7. The hook and power tool combination according to claim 6, wherein the joint portion comprises a weldable tubular portion, which is formed from a plate-like member and made by bending a center part of the plate-like member into a tubular shape and by which the slip-off preventing portion and the hook body are sheathed, and wherein the slip-off preventing portion and the hook body are joined to the weldable tubular portion by welding.

8. The hook and power tool combination according to claim 7, wherein the joint portion comprises a protruding strip, which is formed from a distal end portion of the plate-like member and is capable of fitting into a slit-hole formed in the lower end portion of the handle.

9. The hook and power tool combination according to claim 7, wherein the joint portion comprises a fixing strip, which is formed from a rear end portion of the plate-like member and is capable of attaching to the lower end portion of the handle.

10. The hook and power tool combination according to claim 9, wherein the fixing strip has an oblong hole extending in a transverse direction of the fixing strip, through which a screw is threadedly engaged with the lower end portion of the handle.

* * * * *